US011038288B2

(12) United States Patent
Peterson et al.

(10) Patent No.: US 11,038,288 B2
(45) Date of Patent: Jun. 15, 2021

(54) ELECTRICAL SPLICE CONNECTOR

(71) Applicant: Aptiv Technologies Limited, St. Michael (BB)

(72) Inventors: David R. Peterson, Aurora, OH (US); Joseph Sudik, Jr., Niles, OH (US)

(73) Assignee: APTIV TECHNOLOGIES LIMITED, St. Michael (BB)

( * ) Notice: Subject to any disclaimer, the term of this patent is extended or adjusted under 35 U.S.C. 154(b) by 0 days.

(21) Appl. No.: 16/670,183

(22) Filed: Oct. 31, 2019

(65) Prior Publication Data

US 2021/0135381 A1 May 6, 2021

(51) Int. Cl.

| | |
|---|---|
| ***H01R 4/48*** | (2006.01) |
| ***H01R 13/52*** | (2006.01) |
| ***H01R 43/20*** | (2006.01) |
| ***H01R 11/12*** | (2006.01) |
| ***H01R 13/506*** | (2006.01) |

(52) U.S. Cl.

CPC ..... *H01R 4/48* (2013.01); *H01R 11/12* (2013.01); *H01R 13/506* (2013.01); *H01R 13/5202* (2013.01); *H01R 43/20* (2013.01)

(58) Field of Classification Search

None

See application file for complete search history.

(56) References Cited

U.S. PATENT DOCUMENTS

| | | | | |
|---|---|---|---|---|
| 3,141,720 | A * | 7/1964 | Johnson | H01R 12/78 439/496 |
| 6,619,964 | B2 * | 9/2003 | Geltsch | H01R 12/61 439/67 |
| 7,063,561 | B2 * | 6/2006 | Pabst | H01R 12/61 439/495 |
| 7,144,256 | B2 | 12/2006 | Pabst et al. | |
| 7,232,334 | B2 | 6/2007 | Shimizu et al. | |
| 9,048,563 | B2 | 6/2015 | Miura et al. | |
| 9,178,297 | B2 * | 11/2015 | Kodaira | H01R 12/774 |
| 9,255,521 | B2 * | 2/2016 | Parry-Jones | F02C 7/00 |
| 2006/0141853 | A1 | 6/2006 | Pabst | |

FOREIGN PATENT DOCUMENTS

| | | | |
|---|---|---|---|
| EP | 0393927 | A1 | 10/1990 |
| EP | 669627 | B1 | 8/2002 |
| EP | 1248321 | A1 | 10/2002 |
| JP | 2006216490 | A | 8/2006 |

OTHER PUBLICATIONS

European Search Report for European Application No. 20201029.4 dated Feb. 22, 2021.

* cited by examiner

*Primary Examiner* — Ross N Gushi

(74) *Attorney, Agent, or Firm* — Carlson, Gaskey & Olds, P.C.

(57) ABSTRACT

An electrical connector includes wiring with multiple wires. Each wire has a conductor covered in insulation. Each wire has a stripped portion that exposes the conductors. The stripped portions are stacked on top of one another. A housing has first and second housing portions. The first housing portion receives the stripped portions. The second housing portion includes a spring that is configured to urge the stripped portions into engagement with one another when the first and second housing portions are secured to another in an assembled connector condition. In one example, an external electrical terminal is mounted to the first housing portion and is electrically connected to the stripped portions.

18 Claims, 4 Drawing Sheets

FIG. 5
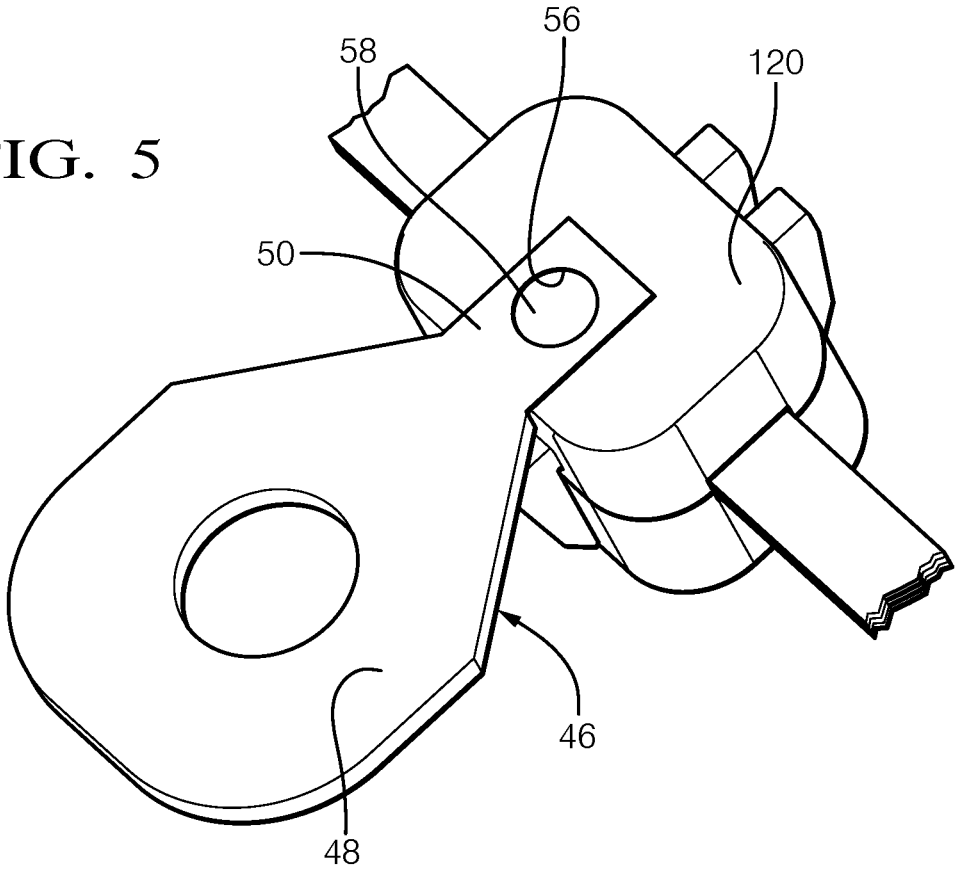
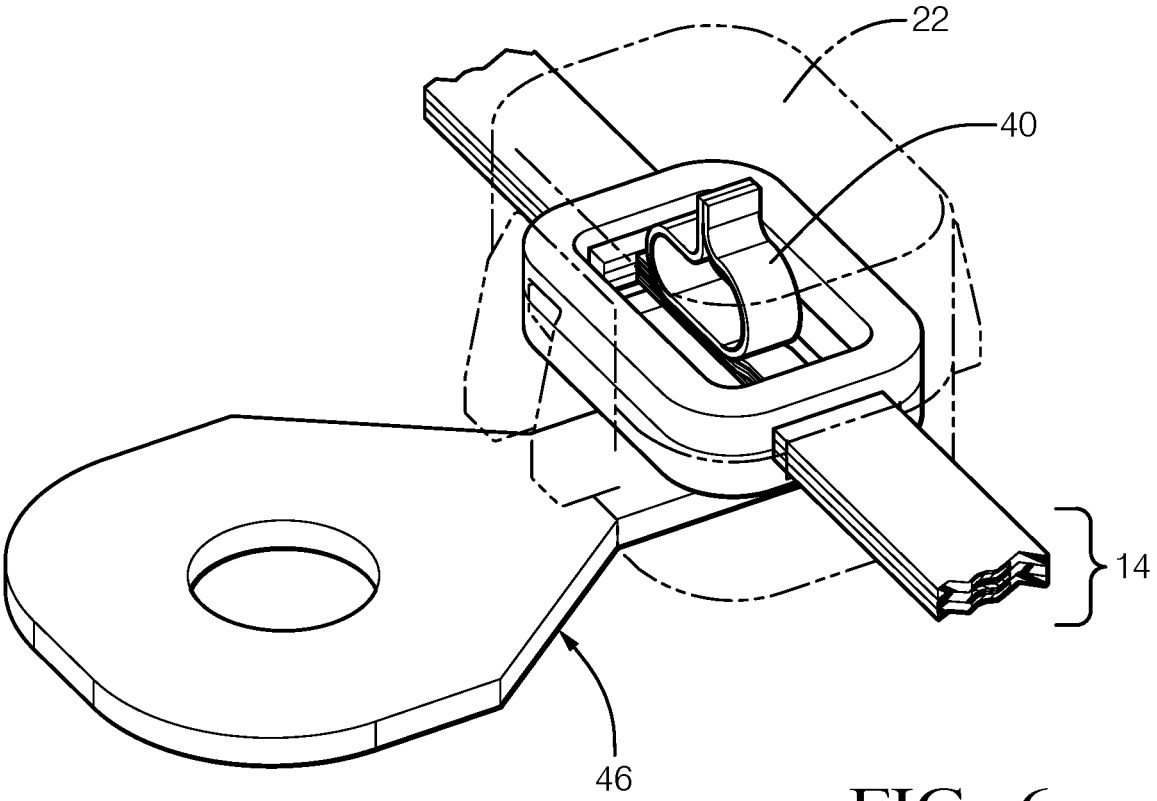
FIG. 6

ELECTRICAL SPLICE CONNECTOR

FIELD OF INVENTION

This disclosure relates to an electrical connector for use in a wiring harness that uses flat wires, for example.

SUMMARY

In one exemplary embodiment, an electrical connector includes wiring with multiple wires. Each wire has a conductor covered in insulation. Each wire has a stripped portion that exposes the conductors. The stripped portions are stacked on top of one another. A housing has first and second housing portions. The first housing portion receives the stripped portions. The second housing portion includes a spring that is configured to urge the stripped portions into engagement with one another when the first and second housing portions are secured to another in an assembled connector condition.

In a further embodiment of any of the above, each conductor is formed of a solid, non-stranded conductive material and each of the wires has a generally rectangular profile that has a width and a height in which the width is at least twice the height.

In a further embodiment of any of the above, the insulation is provided on either side of the stripped portion of at least one of the wires.

In a further embodiment of any of the above, the first housing portion includes a supplemental locating feature that includes a first set of barbs that are spaced apart from a second set of barbs. The first and second sets of barbs retain the stripped portion. The insulation includes edges that are adjacent to the first and second sets of barbs to longitudinally locate the wiring relative to the housing.

In a further embodiment of any of the above, the housing includes at least one snap removably connects the first and second housing portions in the assembled connector condition.

In a further embodiment of any of the above, the spring has a curved portion that terminates in at least one end that is received in a slot in the second housing portion.

In a further embodiment of any of the above, an external electrical terminal is mounted to the housing and is electrically connected to the stripped portions.

In a further embodiment of any of the above, the external electrical terminal is mounted on the first housing portion.

In a further embodiment of any of the above, the external electrical terminal includes a hole. A fastener is received in the hole to secure the external electrical terminal to the housing.

In a further embodiment of any of the above, the external electrical terminal includes a leg that extends into the first housing portion to engage the stripped portion on a side opposite the spring. The first housing portion is formed around the leg.

In a further embodiment of any of the above, the leg is characterized as having a J-shape. A terminal end of the J-shape engages the stripped portion.

In a further embodiment of any of the above, first and second seals are respectively supported by the first and second housing portions and arranged on opposing sides of the wiring.

In another exemplary embodiment, an electrical connector includes a wire that has a conductor covered in insulation. The wire has a stripped portion that exposes the conductors. The wire has a generally rectangular profile that has a width and a height in which the width is at least twice the height. A housing has first and second housing portions. The first housing portion receives the stripped portion. The first and second housing portions are secured to another in an assembled connector condition. An external electrical terminal is mounted to the first housing portion and is electrically connected to the stripped portions.

In a further embodiment of any of the above, the insulation is provided on either side of the stripped portion of the wire. The first housing portion includes a supplemental locating feature that includes a first set of barbs spaced apart from a second set of barbs. The first and second sets of barbs retain the stripped portion. The insulation includes edges adjacent to the first and second sets of barbs to longitudinally locate the wire relative to the housing.

In a further embodiment of any of the above, a spring is mounted to the second housing portion. The external electrical terminal includes a leg that extends into the first housing portion to engage the stripped portion on a side opposite the spring. The first housing portion is formed around the leg. The spring has a curved portion that engages the stripped portion and terminates in at least one end that is received in a slot in the second housing portion.

In a further embodiment of any of the above, the leg is characterized as having a J-shape. A terminal end of the J-shape engages the stripped portion.

In a further embodiment of any of the above, the housing includes at least one snap feature removably connects the first and second housing portions in the assembled connector condition.

In a further embodiment of any of the above, the external electrical terminal includes a hole. A fastener is received in the hole to secure the external electrical terminal to the first housing portion.

In a further embodiment of any of the above, first and second seals are respectively supported by the first and second housing portions and are arranged on opposing sides of the wiring.

In another exemplary embodiment, a method of assembling an electrical connector includes providing at least one wire that has a conductor covered in insulation. The wire has a stripped portion that exposes the conductors, and the insulation is provided on either side of the stripped portion of the wire. Each of the wires has a generally rectangular profile that have a width and a height in which the width is at least twice the height. The stripped portion is mounted into a first housing portion. The stripped portion engages with a spring carried by a second housing portion with the first and second housing portions arranged in an assembled connector condition.

In a further embodiment of any of the above, the mounting step includes engaging the stripped portion with an external electrical terminal.

In a further embodiment of any of the above, the engaging step includes clamping multiple stripped portions of multiple wires into engagement with one another.

BRIEF DESCRIPTION OF THE DRAWINGS

The disclosure can be further understood by reference to the following detailed description when considered in connection with the accompanying drawings wherein:

FIG. 5 is an opposite perspective view of the electrical connector shown in FIG. 4.

FIG. 6 is a perspective view of the electrical connector shown in FIG. 4 with first and second housing portions shown in phantom.

DETAILED DESCRIPTION

Figure 1:
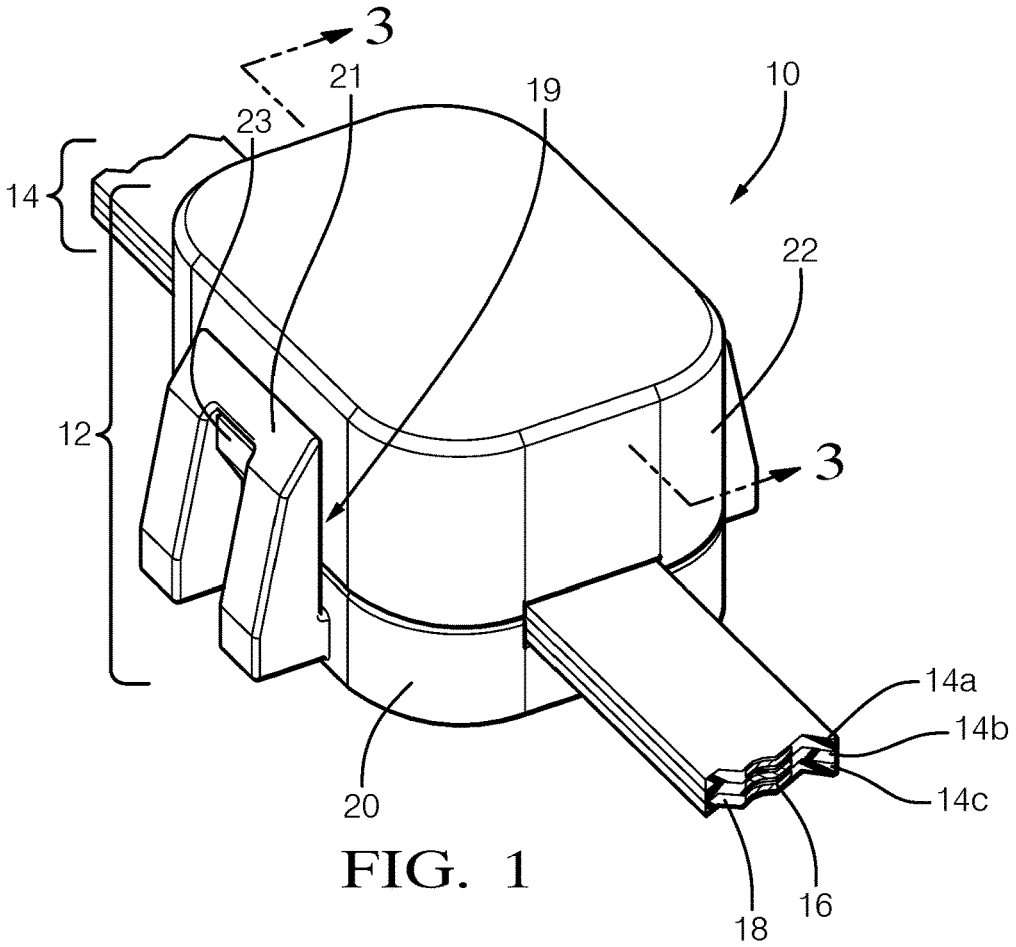
FIG. 1 is a perspective view of an electrical connector in an assembled connector condition.

An example electrical connector 10 is illustrated in FIG. 1. The connector 10 is suitable particularly for use with flat wires and is configured as a splice connection for multiple wires. The connector 10 includes a housing 12, which may be constructed from multiple plastic pieces, such as first and second housing portions 20, 22. The first and second housing portions 20, 22 may include features that are "keyed" to provide "fool proof" assembly. The exemplary housing 12 may vary from the configuration depicted, particularly the second housing portion 22, which may be integrated with an electrical component such as a light, sensor, electrical connector, or other electrical device. In the example, the second housing portion 22 includes electrical contacts provided by springs 40 (FIG. 3) that supply electrical continuity between wiring 14 and the electrical component.

A snap feature 19 is provided on each of opposing sides of the housing 12. The snap includes a tab 21 provided on one of the first and second housing portions 20, 22 and a ramped portion 23 is provided on the other of the first and second housing portions 20, 22. It should be understood that one snap 19 may be provided on the housing 12, particularly if a living hinge is used on the opposing side of the housing 12 to provide a one-piece clamshell-type configuration.

The connector 10 is used in conjunction with wiring 14, which may include one or more wires 14*a*, 14*b*, 14*c*. Each wire includes a relatively flat conductor 16 that is generally rectangular and is encased in a non-conductive, flexible plastic insulation 18 to provide a cross-sectional aspect ratio of at least 2:1 with respect to the width and the height. As used herein, "generally rectangular" includes any shape having a width greater than its height in cross section and may include rectangular, parallelogram, trapezoid, oval, obround, and elliptical shapes. In some embodiments, the aspect ratio may be at least 3:1. In other embodiments, the aspect ratio may be at least 5:1. The conductor 16 is provided by non-stranded electrically conductive material, such as a flat copper wire plated with tin. The adjacent wires 14*a*, 14*b*, 14*c* may be interconnected with insulation material that forms webbing, which provides structurally integrity to the wiring 14 during handling. For the splice connection, this webbing may be removed to enable the wires 14*a*, 14*b*, 14*c* to be more easily arranged one on top of the other as shown.

Figure 2:
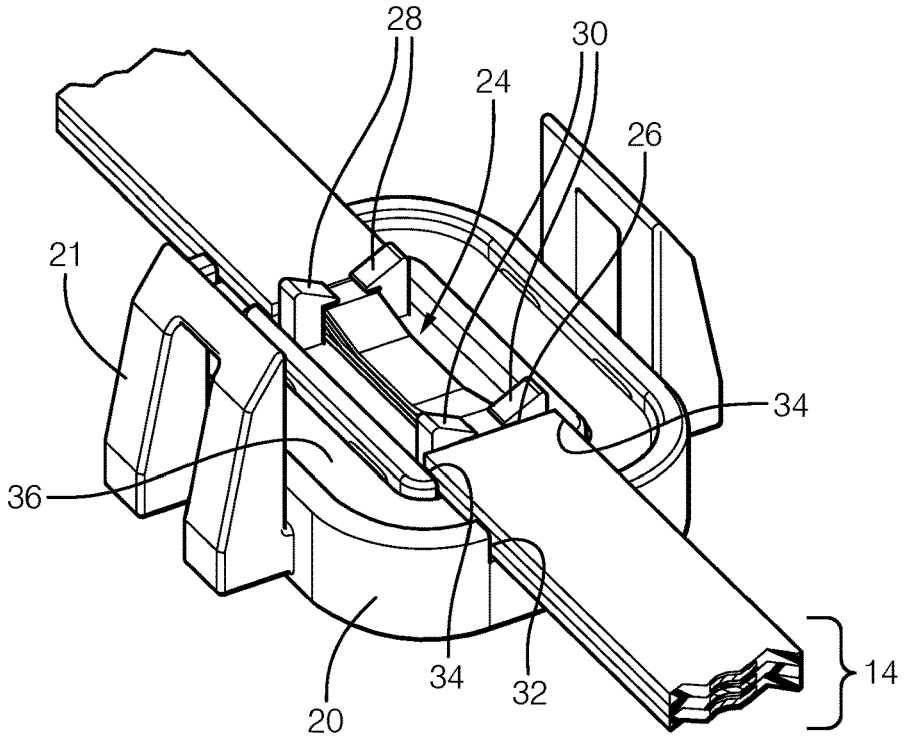
FIG. 2 is a perspective view with a first housing portion of the FIG. 1 electrical connector with a second housing portion removed.

It is desirable to positively locate the wiring 14 with respect to the housing 12 and to provide strain relief to the wires 14*a*, 14*b*, 14*c*. To this end, various locating features may be used between the housing 12 and wiring 14 to orient and securely hold the wiring 14 during assembly and use. Referring to FIG. 2, the wires 14*a*, 14*b*, 14*c* each have a stripped portion 24 that expose the conductors 16 at a longitudinal location defined by edges 26 of the insulation 18. That is, at least one of the stripped portions 24 are bounded by insulation 18 at either end. In the example, the first housing portion 20 includes a first set of barbs 28 spaced apart from a second set of barbs 30. The conductors 16 are clipped in beneath and retained by the same set of barbs in a stacked relationship to one another. The first and second sets of barbs 28, 30 retain the stripped portions 24 longitudinally as well, such that the edges 26 are longitudinally located by the barbs to orient the wiring 14 in the desired position relative to the housing 12. In this manner, the edges 26 and barbs 28, 30 cooperate to provide locating features that interact with one another to secure the wiring 14 relative to housing 12.

A recess 32 on either side of the first housing portion 20 laterally locates the insulation 18 of the wiring 14. A pair of ridges 34 extend from at least the first housing portion 20 and straddles the stripped portions 24. The edges 26 are retained laterally between ridges 34.

Figure 3:
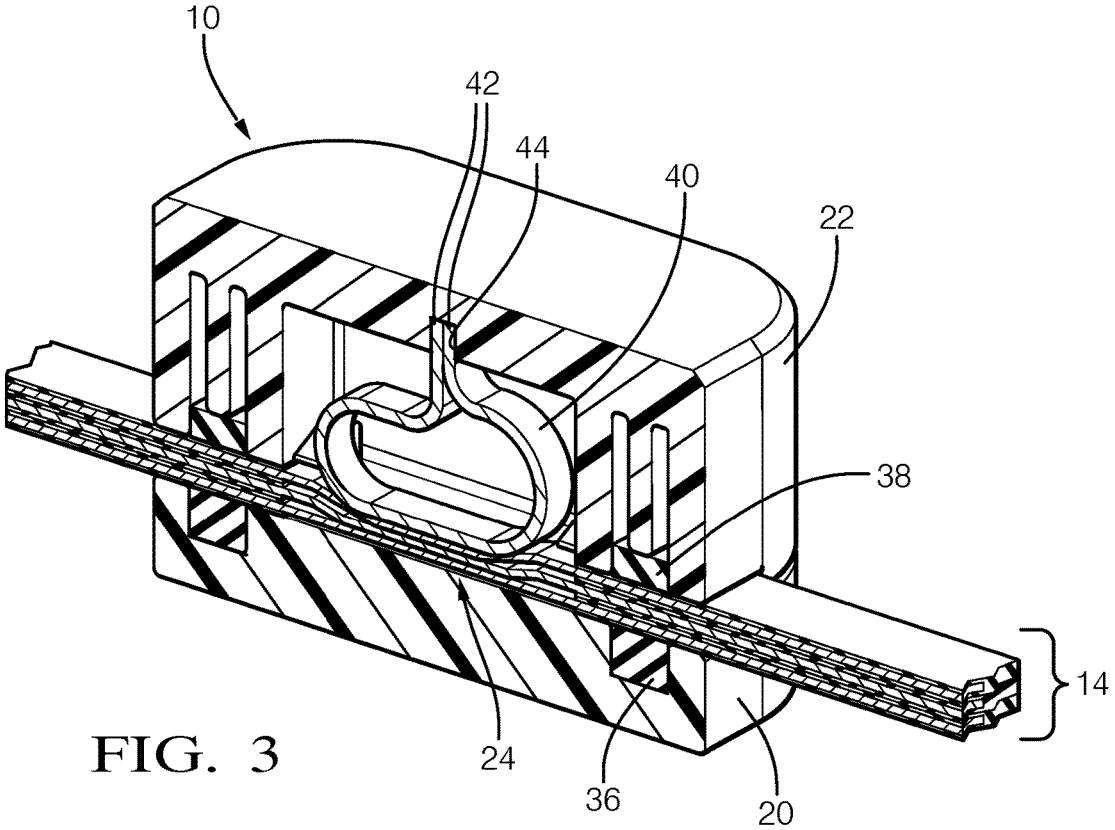
FIG. 3 is a cross-sectional view through the electrical connector and taken along line 3-3 in FIG. 1.
Figure 4:
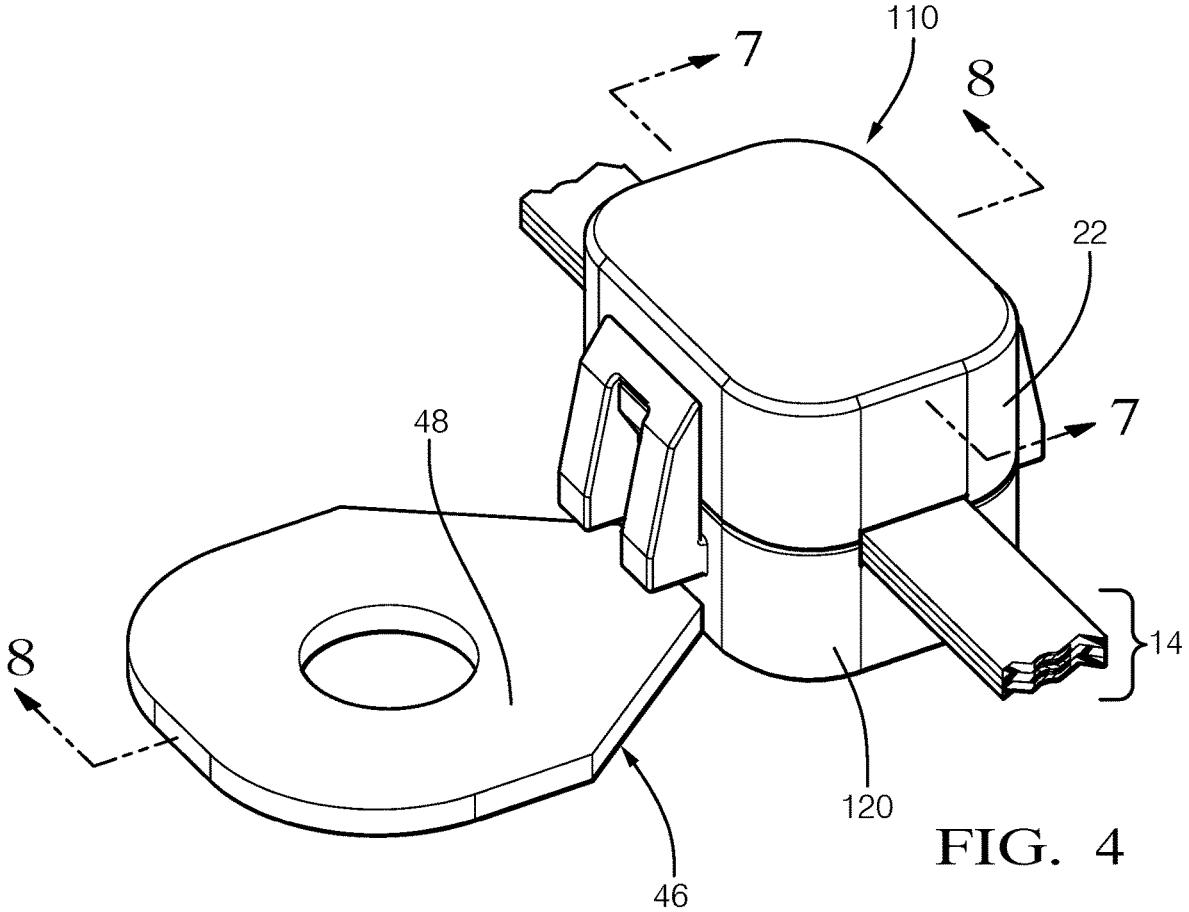
FIG. 4 is a perspective view of an electrical connector with an external electrical terminal.
Figure 7:
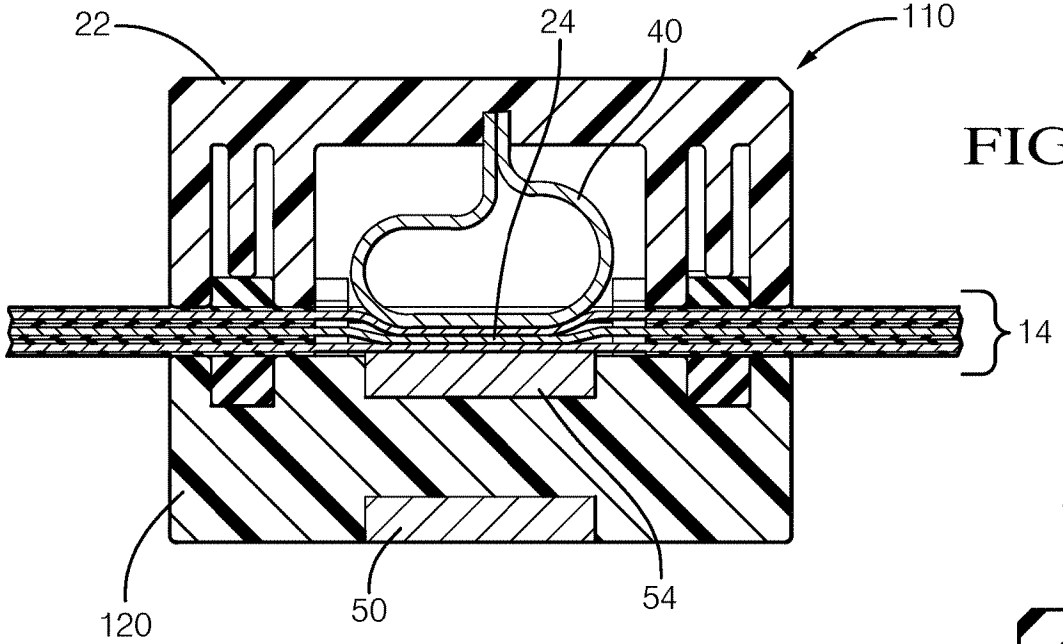
FIG. 7 is a cross-sectional view through the electrical connector shown in FIG. 4 and taken along line 7-7.
Figure 8:
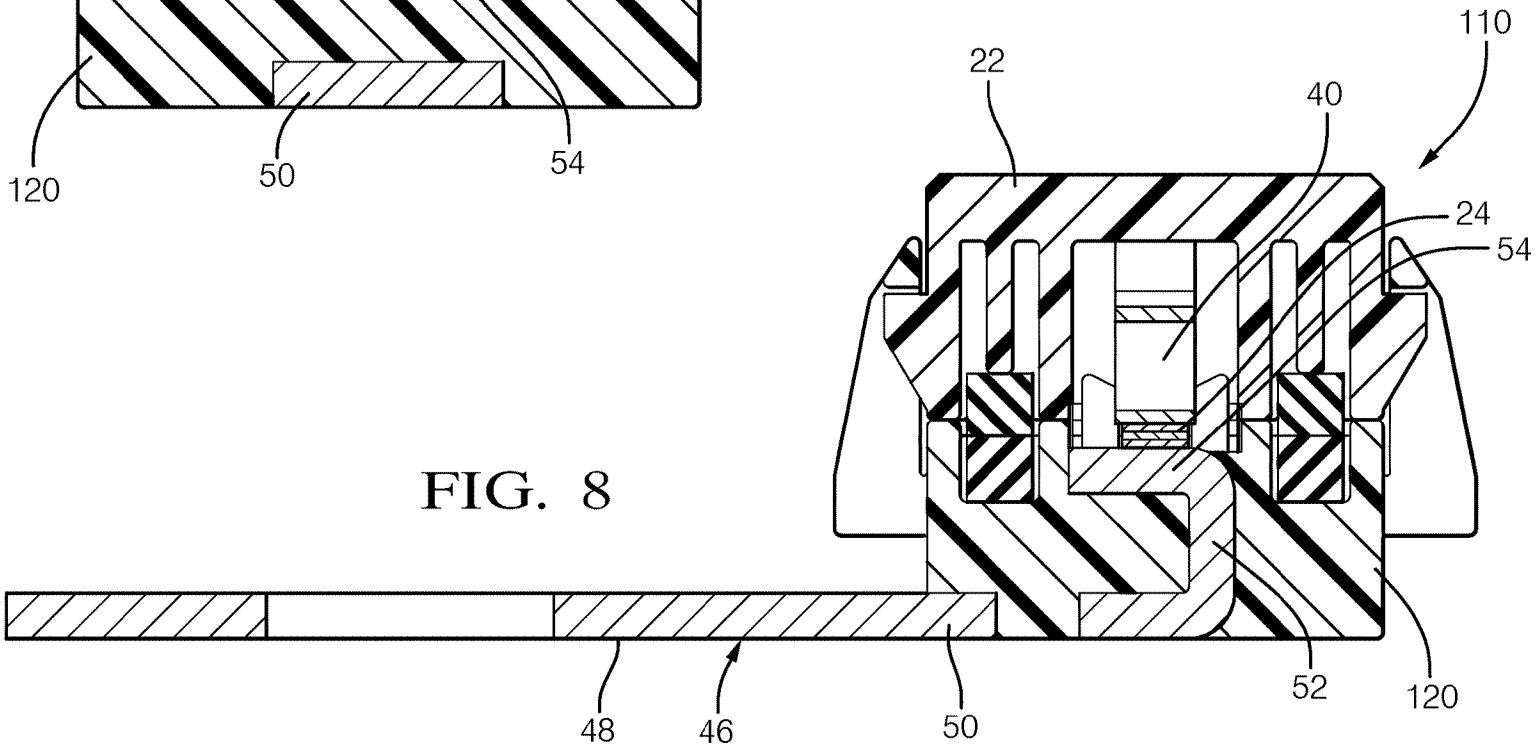
FIG. 8 is a cross-sectional view through the electrical connector shown in FIG. 4 and taken along line 8-8.

With the housing 12 arranged in the assembled connector condition, illustrated FIGS. 1 and 3, a spring 40 carried by the second housing portion 22 clamps the stripped portions 24 into engagement with one another. In the example arrangement, the spring 40 has a curved portion terminating in opposing ends 42 are received in a slot 44 of the second housing portion 22, best shown in FIG. 3.

With continuing reference to FIG. 3, first and second seals 36, 38 may be respectively provided in the first and second housing portions 20, 22 to seal about the wiring 14 and between the first and second housing portions 20, 22, providing a weatherproof seal.

Another type of electrical connector 110 is illustrated in FIGS. 4-8. The electrical connector 110 includes an external electrical terminal 46, such as a ring terminal configured to be connected to a grounding stud. In the example, the electrical terminal 46 includes a connection portion 48, which may be the ring terminal, a male blade terminal, or a female socket terminal, for example. The connector portion 48 adjoins a base 50 mounted to the housing 12. In the example, the base 50 includes a hole 56 receiving a fastener 58 that secures the base 50 to the first housing portion 20. In the example, the fastener 58 is an overmolded portion of the first housing portion 120, although other types of fasteners may be used, such as rivets or threaded fastening elements.

The base 50 extends to a J-shaped end provided by first and second legs 52, 54. The second leg 54 is provided by a terminal end arranged beneath and engagement with the stripped portions 24. The spring 40 biases the stripped portions 24 into engagement with the second leg 54 thereby providing electrical continuity between the stripped portions 24 and the electrical terminal 46.

The electrical terminal 46 could instead be provided on the second housing portion 22 and electrically connected to the spring 40.

In operation, a method of assembling an electrical connector, such as the spliced connector from FIGS. 1-3 or the electrical terminal connector of FIGS. 4-8 comprises the steps of providing at least one wire having a conductor 16 covered in insulation 18. The wire 14 has a stripped portion 24 exposing the conductor 16. The stripped portion 24 of one or more wires is mounted into the first housing portion 20. The stripped portion 24 is engaged with a spring 40 carried by the second housing portion 22 with the first and second housing portions 20, 22 arranged in the assembled-connector condition. A ring terminal or other external electrical terminal may be provided on the housing 12.

Additional examples are presented below.

Example 1. An electrical connector (10) comprising wiring (14) with multiple wires (14*a*, 14*b*), each wire having a conductor (16) covered in insulation (18), each wire having a stripped portion (24) exposing the conductors (16), wherein the stripped portions (24) are stacked on top of one another and a housing (12) having first and second housing portions (20, 22) the first housing portion (20) receiving the stripped portions (24), and the second housing portion (22) includes a spring (40) configured to urge the stripped portions (24) into engagement with one another when the first and second housing portions (20, 22) are secured to another in an assembled connector condition.

Example 2. The electrical connector (10) of claim 1, wherein each conductor (16) is formed of a solid, non-stranded conductive material and wherein each of the wires (14*a*, 14*b*) has a generally rectangular profile having a width and a height in which the width is at least twice the height, wherein the insulation (18) is provided on either side of the stripped portion (24) of at least one of the wires (14*a*, 14*b*).

Example 3. The electrical connector (10) of claim 1 or 2, wherein the first housing portion (20) includes a supplemental locating feature comprising a first set of barbs (28) spaced apart from a second set of barbs (30), the first and second sets of barbs (28, 30) retaining the stripped portion (24), and the insulation (18) including edges (26) adjacent to the first and second sets of barbs (28, 30) to longitudinally locate the wiring (14) relative to the housing (12).

Example 4. The electrical connector (10) of any one of the preceding claims, wherein the housing (12) includes at least one snap (19) removably connecting the first and second housing portions (20, 22) in the assembled connector condition.

Example 5. The electrical connector (10) of any one of the preceding claims, wherein the spring (40) has a curved portion terminating in at least one end (42) that is received in a slot (44) in the second housing portion (22), and/or optionally, comprising an external electrical terminal (46) mounted to the housing (12) and electrically connected to the stripped portions (24).

Example 6. The electrical connector (10) of claim 5, wherein the external electrical terminal (46) includes a hole (56), and a fastener (58) is received in the hole (56) to secure the external electrical terminal (46) to the housing (12).

Example 7. The electrical connector (10) of claim 5 or 6, wherein the external electrical terminal (46) includes a leg extending into the first housing portion (20) to engage the stripped portion (24) on a side opposite the spring (40) and wherein the first housing portion (20) is formed around the leg, and wherein the leg is characterized as having a J-shape and wherein a terminal end (54) of the J-shape engages the stripped portion (24).

Example 8. The electrical connector (10) of any one of the preceding claims, comprising first and second seals (36, 38) respectively supported by the first and second housing portions (20, 22) and arranged on opposing sides of the wiring (14).

Example 9. An electrical connector (10) comprising a wire (14) having a conductor (16) covered in insulation (18), the wire (14) having a stripped portion (24) exposing the conductors (16), wherein the wire (14) has a generally rectangular profile having a width and a height in which the width is at least twice the height, a housing (12) having first and second housing portions (20, 22), the first housing portion (20) receiving the stripped portion (24), the first and second housing portions (20, 22) secured to another in an assembled connector condition, and an external electrical terminal (46) mounted to the first housing portion (20) and electrically connected to the stripped portions (24).

Example 10. The electrical connector (10) of claim 9, wherein the insulation (18) is provided on either side of the stripped portion (24) of the wire (14), the first housing portion (20) includes a supplemental locating feature comprising a first set of barbs (28) spaced apart from a second set of barbs (30), the first and second sets of barbs (28, 30) retaining the stripped portion (24), and the insulation (18) including edges (26) adjacent to the first and second sets of barbs (28, 30) to longitudinally locate the wire (14) relative to the housing (12).

Example 11. The electrical connector (10) of claim 9 or 10, further comprising a spring (40) mounted to the second housing portion (22), wherein the external electrical terminal (46) includes a leg extending into the first housing portion (20) to engage the stripped portion (24) on a side opposite the spring (40), wherein the first housing portion (20) is formed around the leg, and wherein the spring (40) has a curved portion engaging the stripped portion (24) and terminating in at least one end (42) that is received in a slot (44) in the second housing portion (22).

Example 12. The electrical connector (10) of claim 11, wherein the leg is characterized as having a J-shape and wherein a terminal end (54) of the J-shape engages the stripped portion (24).

Example 13. The electrical connector (10) of claim 11 or 12, wherein the housing (12) includes at least one snap (19) feature removably connecting the first and second housing portions (20, 22) in the assembled connector condition.

Example 14. The electrical connector (10) of any one of the claims 9 to 13, wherein the external electrical terminal (46) includes a hole (56), and a fastener (58) is received in the hole (56) to secure the external electrical terminal (46) to the first housing portion (20).

Example 15. The electrical connector (10) of any one of the claims 9 to 14, comprising first and second seals (36, 38) respectively supported by the first and second housing portions (20, 22) and arranged on opposing sides of the wiring (14).

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. An electrical connector comprising:

wiring with multiple wires, each wire having a conductor covered in insulation, each wire having a stripped portion exposing the conductors, wherein the stripped portions are stacked on top of one another; and a housing having first and second housing portions, the first housing portion receiving the stripped portions, and the second housing portion includes a spring configured to urge the stripped portions into engagement with one another when the first and second housing portions are secured to another in an assembled connector condition, wherein at least one of the wires enter a first exterior side of the housing and exit the housing through a second side of the housing opposite the first exterior side, the spring arranged between the first and second exterior sides, wherein the spring has a curved portion and terminates in opposing ends that are arranged adjacent to one another and are received in a slot in the second housing portion.

2. The electrical connector of claim 1, wherein each conductor is formed of a solid, non-stranded conductive material and wherein each of the wires has a generally rectangular profile having a width and a height in which the width is at least twice the height.

3. The electrical connector of claim 2, wherein the insulation is provided on either side of the stripped portion of at least one of the wires.

4. The electrical connector of claim 1, wherein the housing includes at least one snap removably connecting the first and second housing portions in the assembled connector condition.

5. An electrical connector comprising:

wiring with multiple wires, each wire having a conductor covered in insulation, each wire having a stripped portion exposing the conductors, wherein the stripped portions are stacked on top of one another; and a housing having first and second housing portions, the first housing portion receiving the stripped portions, and the second housing portion includes a spring configured to urge the stripped portions into engagement with one another when the first and second housing portions are secured to another in an assembled connector condition, wherein at least one of the wires enter a first exterior side of the housing and exit the housing through a second side of the housing opposite the first exterior side, the spring arranged between the first and second exterior sides, wherein the first housing portion includes a supplemental locating feature comprising a first set of barbs spaced apart from a second set of barbs, the first and second sets of barbs retaining and engaging the stripped portion, and the insulation including edges adjacent to the first and second sets of barbs to longitudinally locate the wiring relative to the housing.

6. An electrical connector comprising:

wiring with multiple wires, each wire having a conductor covered in insulation, each wire having a stripped portion exposing the conductors, wherein the stripped portions are stacked on top of one another;

a housing having first and second housing portions, the first housing portion receiving the stripped portions, and the second housing portion includes a spring configured to urge the stripped portions into engagement with one another when the first and second housing portions are secured to another in an assembled connector condition, wherein at least one of the wires enter a first exterior side of the housing and exit the housing through a second side of the housing opposite the first exterior side, the spring arranged between the first and second exterior sides; and an external electrical terminal mounted to the housing and electrically connected to the stripped portions.

7. An electrical connector comprising:

wiring with multiple wires, each wire having a conductor covered in insulation, each wire having a stripped portion exposing the conductors, wherein the stripped portions are stacked on top of one another;

a housing having first and second housing portions, the first housing portion receiving the stripped portions, and the second housing portion includes a spring configured to urge the stripped portions into engagement with one another when the first and second housing portions are secured to another in an assembled connector condition; and an external electrical terminal mounted to the housing and electrically connected to the stripped portions, wherein the external electrical terminal includes a hole, and a fastener is received in the hole to secure the external electrical terminal to the housing.

8. The electrical connector of claim 7, wherein the external electrical terminal is mounted on the first housing portion.

9. The electrical connector of claim 8, wherein the external electrical terminal includes a leg extending into the first housing portion to engage the stripped portion on a side opposite the spring and wherein the first housing portion is formed around the leg.

10. The electrical connector of claim 9, wherein the leg is characterized as having a J-shape and wherein a terminal end of the J-shape engages the stripped portion.

11. An electrical connector comprising:

wiring with multiple wires, each wire having a conductor covered in insulation, each wire having a stripped portion exposing the conductors, wherein the stripped portions are stacked on top of one another;

a housing having first and second housing portions, the first housing portion receiving the stripped portions, and the second housing portion includes a spring configured to urge the stripped portions into engagement with one another when the first and second housing portions are secured to another in an assembled connector condition, wherein at least one of the wires enter a first exterior side of the housing and exit the housing through a second side of the housing opposite the first exterior side, the spring arranged between the first and second exterior sides; and first and second seals respectively supported by the first and second housing portions and arranged on opposing sides of the wiring.

12. An electrical connector comprising:

a wire having a conductor covered in insulation, the wire having a stripped portion exposing the conductors, wherein the wire has a generally rectangular profile having a width and a height in which the width is at least twice the height;

a housing having first and second housing portions, the first housing portion receiving the stripped portion, the first and second housing portions secured to another in an assembled connector condition, wherein the wire enters a first exterior side of the housing and exit the housing through a second side of the housing opposite the first exterior side, the stripped portion arranged between the first and second exterior sides; and an external electrical terminal mounted to the first housing portion and electrically connected to the stripped portions.

13. The electrical connector of claim 12, wherein the insulation is provided on either side of the stripped portion of the wire, the first housing portion includes a supplemental locating feature comprising a first set of barbs spaced apart from a second set of barbs, the first and second sets of barbs retaining and engaging the stripped portion, and the insulation including edges adjacent to the first and second sets of barbs to longitudinally locate the wire relative to the housing.

14. The electrical connector of claim 12, further comprising a spring mounted to the second housing portion, wherein the external electrical terminal includes a leg extending into the first housing portion to engage the stripped portion on a side opposite the spring, wherein the first housing portion is formed around the leg, and wherein the spring has a curved portion engaging the stripped portion and terminating in at least one end that is received in a slot in the second housing portion.

15. The electrical connector of claim 14, wherein the leg is characterized as having a J-shape and wherein a terminal end of the J-shape engages the stripped portion.

16. The electrical connector of claim 14, wherein the housing includes at least one snap feature removably connecting the first and second housing portions in the assembled connector condition.

17. The electrical connector of claim 12, comprising first and second seals respectively supported by the first and second housing portions and arranged on opposing sides of the wire.

18. An electrical connector comprising:

a wire having a conductor covered in insulation, the wire having a stripped portion exposing the conductors, wherein the wire has a generally rectangular profile having a width and a height in which the width is at least twice the height;

a housing having first and second housing portions, the first housing portion receiving the stripped portion, the first and second housing portions secured to another in an assembled connector condition; and an external electrical terminal mounted to the first housing portion and electrically connected to the stripped portions, wherein the external electrical terminal includes a hole, and a fastener is received in the hole to secure the external electrical terminal to the first housing portion.

* * * * *